US011284722B1

(12) United States Patent
Chan

(10) Patent No.: US 11,284,722 B1
(45) Date of Patent: Mar. 29, 2022

(54) FOLDING CHAIR

(71) Applicant: Alexander Chan, Alameda, CA (US)

(72) Inventor: Alexander Chan, Alameda, CA (US)

( * ) Notice: Subject to any disclaimer, the term of this patent is extended or adjusted under 35 U.S.C. 154(b) by 0 days.

(21) Appl. No.: 17/329,087

(22) Filed: May 24, 2021

(51) Int. Cl.

| | |
|---|---|
| ***A47C 4/28*** | (2006.01) |
| ***A47C 4/30*** | (2006.01) |
| ***A47C 7/02*** | (2006.01) |
| ***A47C 31/11*** | (2006.01) |
| ***A47C 4/44*** | (2006.01) |
| ***A47C 4/34*** | (2006.01) |
| *A47C 4/32* | (2006.01) |
| *A47C 4/42* | (2006.01) |

(52) U.S. Cl.

CPC ..... *A47C 4/28* (2013.01); *A47C 4/30* (2013.01); *A47C 4/34* (2013.01); *A47C 4/44* (2013.01); *A47C 7/021* (2013.01); *A47C 7/0213* (2018.08); *A47C 31/11* (2013.01); *A47C 4/32* (2013.01); *A47C 4/42* (2013.01)

(58) Field of Classification Search

CPC .... A47C 4/28; A47C 4/30; A47C 4/32; A47C 4/34; A47C 4/42; A47C 4/44; A47C 7/021; A47C 7/0213; A47C 31/11

USPC ..... 297/16.2, 27, 28, 31, 39, 45, 46, 51, 52, 297/218.1, 219.1, 225, 228.1, 228.13, 229

See application file for complete search history.

(56) References Cited

U.S. PATENT DOCUMENTS 2,638,970 A * 5/1953 Harber ..... A47C 4/48 297/39
2,871,921 A * 2/1959 Arnold ..... A47C 4/283 297/39
3,279,734 A * 10/1966 Kramer ..... A47C 4/24 248/166
4,241,950 A * 12/1980 Simpson ..... A47C 4/24 297/18
4,613,185 A * 9/1986 Marchesini ..... A47C 4/20 297/39
6,131,992 A 10/2000 Chang
7,000,983 B1 2/2006 Tsai
9,867,466 B2 1/2018 Lovley, II
(Continued)

FOREIGN PATENT DOCUMENTS

GB 652597 A * 4/1951 ..... A47C 4/42
GB 739928 A * 11/1955 ..... A47C 4/48
(Continued)

*Primary Examiner* — Robert Canfield
(74) *Attorney, Agent, or Firm* — Kanika Radhakrshnan; Evergreen Valley Law Group

(57) ABSTRACT

Various embodiments provide a folding chair. The folding chair includes a frame body having a back, an arm, a front leg and a rear leg frame members. The front and rear leg frame members are configured to support the frame body in an upright position on a ground surface in an unfolded state. Each frame member includes an intermediate section, and a pair of extended sections extending from the intermediate section forming a U-shaped frame member. The frame member also includes a plurality of connecting members moveably coupling the plurality of frame members for allowing the frame body to attain the unfolded state or a folded state. The folding chair also includes a cover member configured to cover the frame body to form at least a seat portion and a backrest portion. The seat portion is supported by the arm frame member and the backrest portion is supported by the back frame member.

16 Claims, 6 Drawing Sheets

(56) References Cited

U.S. PATENT DOCUMENTS

| | | | | |
|---|---|---|---|---|
| 9,993,083 | B2 | 6/2018 | Choi | |
| 10,159,349 | B1 * | 12/2018 | Frankel | A47C 4/30 |
| 10,610,020 | B2 * | 4/2020 | Garrison | A47C 4/18 |
| 2013/0328362 | A1 * | 12/2013 | Miller | A47C 7/62<br>297/188.2 |
| 2015/0359332 | A1 | 12/2015 | Yang | |

FOREIGN PATENT DOCUMENTS

| | | | | |
|---|---|---|---|---|
| JP | 11178671 | A * | 7/1999 | |
| WO | WO-8806019 | A1 * | 8/1988 | A47C 4/48 |

* cited by examiner

FOLDING CHAIR

TECHNICAL FIELD

The present disclosure relates generally to furniture and, more particularly to, a folding chair.

BACKGROUND

Folding chairs have been very popular from the time of their conception. A typical type of folding chair includes a chair frame constructed by metal tubes with a fabric seat and back support mounted on the chair frame.

However, conventional or current folding chairs of this type possess a number of drawbacks. For example, current folding chairs that are available in the market do not have the appeal of upholstered furniture because folding mechanisms and metal frames are unsightly and give the appearance of inexpensive temporary furniture. Additionally, the folding chairs are usually less comfortable than fully upholstered furniture as support systems (i.e. the seat fabric) do a poor job of avoiding contact between the chair frames and body parts of a sitting person. To avoid contact between the body and the support frame, some folding chairs have seat and back supports that are suspended from the frame. These sling chairs generally suffer from the defect that the shape of the fabric when a person sits in the chair typically causes the person to pinch his/her legs against each other. In light of the foregoing discussion, there exists a need to overcome the aforementioned drawbacks associated with the folding chairs.

SUMMARY

Various embodiments of the present disclosure provide a folding chair that hide a frame body of the chair, provide look and feel of a typical upholstered chair, and attain folded state with a flat compact configuration.

In an embodiment, a folding chair is disclosed. The folding chair includes a frame body. The frame body includes a plurality of frame members having a back frame member, an arm frame member, a front leg frame member and a rear leg frame member. The front and rear leg frame members are configured to support the frame body in an upright position on a ground surface in an unfolded state. Each frame member includes an intermediate section, and a pair of extended sections extending from the intermediate section forming a U-shaped frame member. The frame body also includes a plurality of connecting members moveably coupling the plurality of frame members for allowing the frame body to attain the unfolded state or a folded state with the plurality of frame members lying adjacent to one another in a compact configuration. The folding chair also includes a cover member configured to cover the frame body to form at least a seat portion and a backrest portion. The seat portion is supported by the arm frame member and the backrest portion is supported by the back frame member.

Other aspects and example embodiments are provided in the drawings and the detailed description that follows.

BRIEF DESCRIPTION OF THE FIGURES

For a more complete understanding of example embodiments of the present technology, reference is now made to the following descriptions taken in connection with the accompanying drawings in which.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details.

Reference in this specification to "one embodiment" or "an embodiment" means that a particular feature, structure, or characteristic described in connection with the embodiment is included in at least one embodiment of the present disclosure. The appearance of the phrase "in an embodiment" in various places in the specification is not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Figure 1:
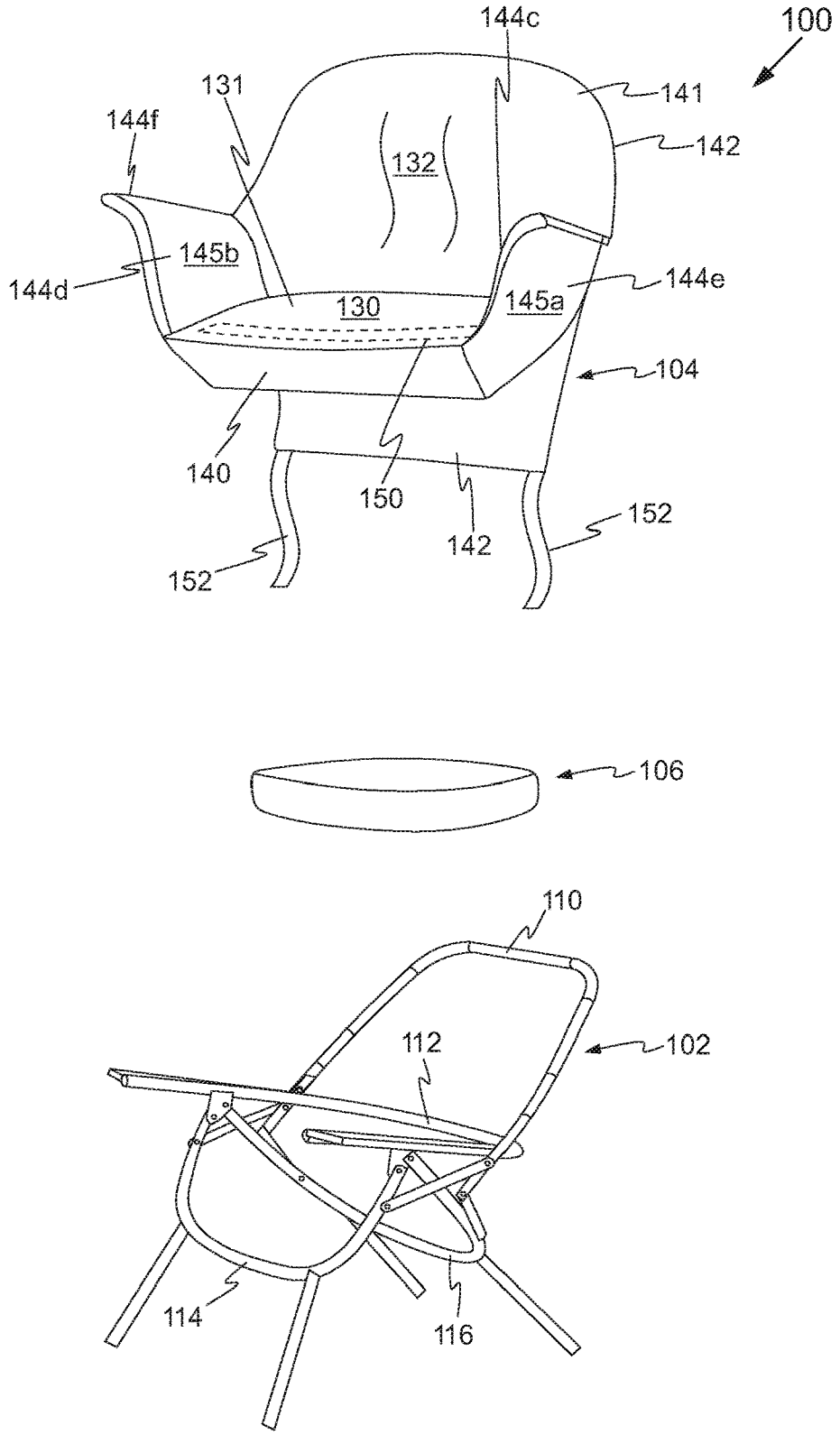
FIG. 1 is a perspective view of a folding chair in an unassembled state, in accordance with an embodiment of the present disclosure.

Referring now to the drawings, FIG. 1 is a perspective view of a folding chair 100 (interchangeably may be referred to as chair 100) in an unassembled state, in accordance with an embodiment of the present disclosure. As shown, the folding chair 100 includes a frame body 102 and a cover member 104. Optionally, the folding chair 100 also includes a cushion 106.

The frame body 102 includes a plurality of frame members, such as a back frame member 110, an arm frame member 112, a front leg frame member 114 and a rear leg frame member 116. Each frame member includes an intermediate section, and a pair of extended sections extending from the intermediate section forming a U-shaped frame member, which is better explained in conjunction with FIG. 2.

Figure 2:
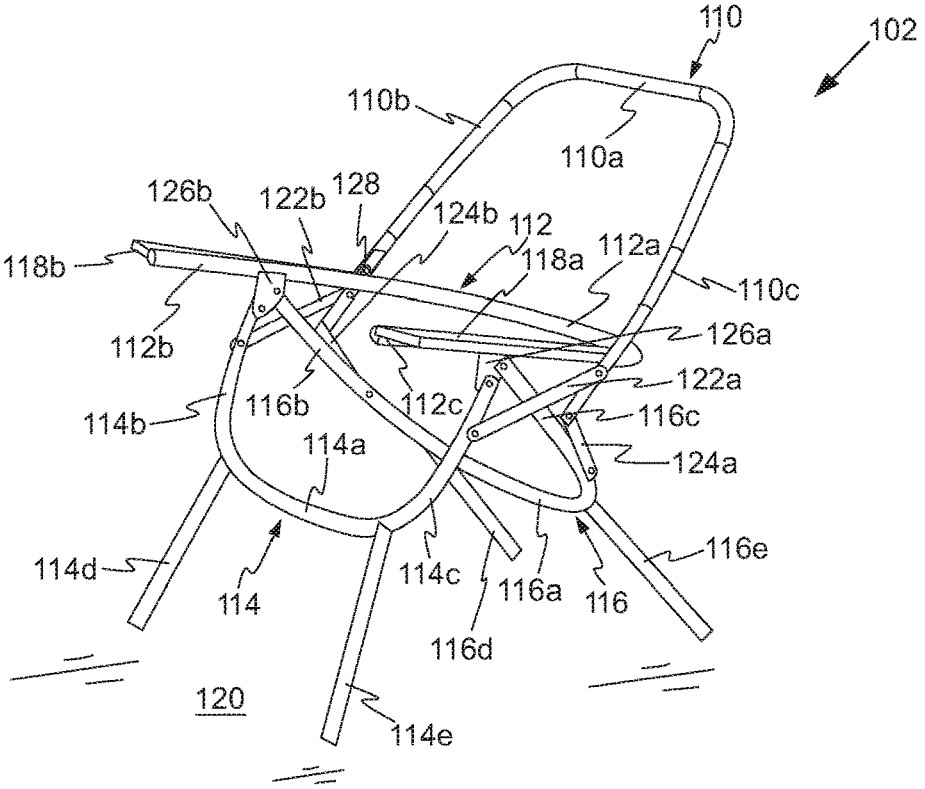
FIGS. 2 and 3 are perspective views of a frame body of the folding chair of FIG. 1 in unfolded and folded states, respectively, in accordance with various embodiments of the present disclosure.

Referring now to FIG. 2, illustrated is the frame body 102 of the folding chair 100 of FIG. 1 in an unfolded state. As shown, each of the back frame member 110, the arm frame member 112, the front leg frame member 114 and the rear leg frame member 116 includes the intermediate section and the pair of extended sections. For example, the back frame member 110 includes an intermediate section 110*a* and the pair of extended sections 110*b*, 110*c*. Similarly, the arm frame member 112 includes an intermediate section 112*a* and the pair of extended sections 112*b*, 112*c*. Further, the front leg frame member 114 includes an intermediate section 114*a* and the pair of extended sections 114*b*, 114*c*. Moreover, the rear leg frame member 116 includes an intermediate section 116*a* and the pair of extended sections 116*b*, 116*c*. Further, as shown, each of the plurality of frame members is configured to be a U-shaped frame member.

Figure 4:
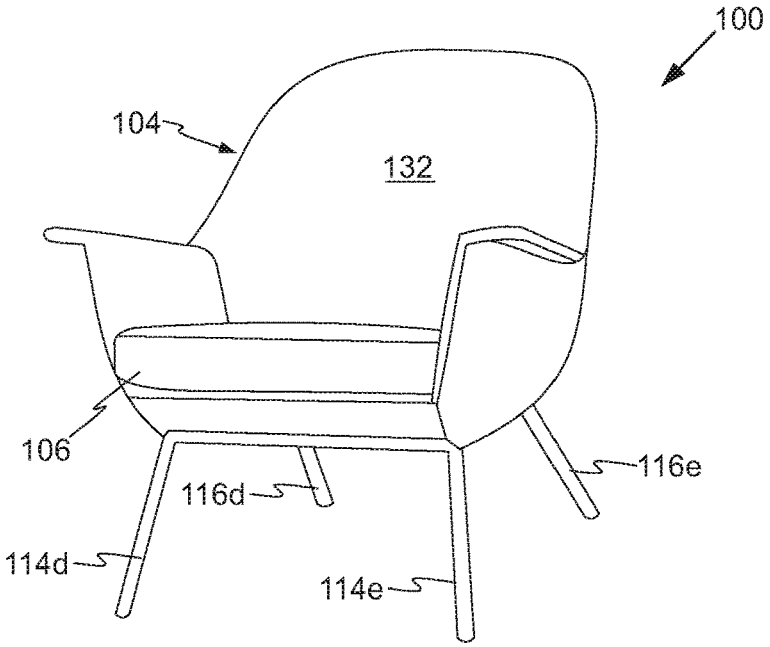
FIGS. 4 and 5 are perspective views of the folding chair of FIG. 1 in assembled unfolded and folded states, respectively, in accordance with various embodiments of the present disclosure.

The front and rear leg frame members 114, 116 are configured to support the frame body 102 in an upright position on a ground surface 120 in an unfolded state. According to an embodiment, each of the front and rear leg frame members 114, 116 comprises a pair of support extensions configured to support the frame body 102 in the upright position on the ground surface 120 in the unfolded state of the frame body 102. For example, the front leg frame member 114 comprises a pair of support extensions 114*d*, 114*e*. Similarly, the rear leg frame member 116 comprises a pair of support extensions 116*d*, 116*e*. The pair of support extensions 114*d*, 114*e* and 116*d*, 116*e* are configured to support the frame body 102 in an upright position on the ground surface 120 in the unfolded state (i.e. when the chair 100 is in use). As shown, the pair of support extensions 114*d*, 114*e* extends form the intermediate section 114*a* of the front leg frame member 114 to hold the intermediate section 114*a* above the ground surface 120 in the unfolded state of the frame body 102. Similarly, the pair of support extensions 116*d*, 116*e* extends form the intermediate section 116*a* of the rear leg frame member 116 to hold the intermediate section 116*a* above the ground surface 120 in the unfolded state of the frame body 102. It will be evident that the unfolded state of the frame body 102 would correspond to an unfolded state of the folding chair 100 with the frame body 102 is covered by the cover member 104 and the cushion 106 is arranged on the cover member 104, as shown in FIG. 4.

In an embodiment, the plurality of frame members, i.e., each of the back frame member 110, the arm frame member 112, the front leg frame member 114 and the rear leg frame member 116 is configured to have the U-shape, with curved edges. Further, each of the back frame member 110, the arm frame member 112, the front leg frame member 114 and the rear leg frame member 116 is a hollow or solid elongate structure, made of a suitable material, which may include but not limited to metal, plastic, rubber, wood or any combination thereof. Further, the hollow or solid elongate structure may include any cross-sectional shape, such as a circular, rectangular and so forth. In example, the back frame member 110, the arm frame member 112, the front leg frame member 114 and the rear leg frame member 116 are metallic tubes, made of aluminum or steel. It will be evident that the plurality of frame members is configured to provide sufficient strength to the frame body 102, which allows the chair 100 to conformably bear a load of a sitting person. Moreover, each of the back frame member 110, the arm frame member 112, the front leg frame member 114 and the rear leg frame member 116 frame member comprises a single elongate member bent to form the U-shaped frame member. Alternatively, the each of the back frame member 110, the arm frame member 112, the front leg frame member 114 and the rear leg frame member 116 frame member comprises a number of elongate members, for example, 3 elongate members coupled to each other to form the U-shape frame member and defining the intermediate section and the pair of extended sections extending from the intermediate section.

In an embodiment, the frame body 102 further includes a pair of armrest flanges 118*a*, 118*b* coupled to the pair of extended sections 112*b*, 112*c* of the arm frame member 112. The pair of armrest flanges 118*a*, 118*b* allow the sitting person to comfortably rest his/her hands thereon. The pair of armrest flanges 118*a*, 118*b* are flat elongate structures, coupled (for example welded) to the pair of extended sections 112*b*, 112*c*, forming arm resting projections.

As shown in FIG. 2, the pair of extended sections 114*b*, 114*c* and 116*b*, 116*c* of the front and rear leg frame members 114, 116 are pivotally coupled to the pair of extended sections 112*b*, 112*c* of the arm frame member 112. Also, the pair of extended sections 110*b*, 110*c* of the back frame member 110 are pivotally coupled to the pair of extended sections 112*b*, 112*c* of the arm frame member 112. Specifically, the plurality of frame members is moveably coupled to each other using a plurality of connecting members.

As shown in FIG. 2, the frame body 102 further includes a plurality of connecting members moveably coupling the plurality of frame members for allowing the frame body 102 to attain the unfolded state (shown in FIG. 2) and a folded state (shown in FIG. 3), in which the plurality of frame members 110, 112, 114, 116 are lying adjacent to one another in a compact configuration. In an embodiment, the plurality of connecting members includes a pair of front links 122*a*, 122*b* connecting the pair of extended sections 110*b*, 110*c* of the back frame member 110 to the pair of extended sections 114*b*, 114*c* of the front leg frame member 114. The plurality of connecting members also includes a pair of rear links 124*a*, 124*b* connecting the pair of extended sections 110*b*, 110*c* of the back frame member 110 to the pair of extended sections 116*b*, 116*c* of the rear leg frame member 116. In an embodiment, the pair of front and rear links 122*a*, 122*b* and 124*a*, 124*b* are flat elongate structure (made of metal or plastic or wood) coupled to the back frame member 110, the front leg frame member 114 and the rear leg frame member 116. Further, the pair of front and rear links 122*a*, 122*b* and 124*a*, 124*b* are coupled to the back frame member 110, the front leg frame member 114 and the rear leg frame member 116 using fasteners, such as rivets, screws and the like, for providing pivotal movement therebetween.

In use, when the back frame member 110 is pivoted (about points connected to the arm frame member 112) forward towards the arm frame member 112 during folding, the front leg frame member 114 is pulled backwards by the pair of front links 122*a*, 122*b* and the rear leg frame member 116 is pulled backwards by the pair of rear links 124*a*, 124*b*, allowing the arm frame member 112, the front leg frame member 114, the rear leg frame member 116 and the back frame member 110 to lay adjacent to one another in the compact configuration. In other words, the pair of front links 122*a*, 122*b* on either side of the chair 100 connected between the back frame member 110 and the front leg frame member 114 pull the front leg frame member 114 into the folded position. Further, the pair of rear links 124*a*, 124*b* on either side of the chair 100 connected between the back frame member 110 and the rear leg frame member 116 pull the rear leg frame member 116 into the folded position. The pair of front and rear links 122*a*, 122*b* and 124*a*, 124*b* work in reverse as the chair 100 is being opened to move the front and rear leg frame members 114, 116 into fixed positions for sitting.

The plurality of connecting members also includes a pair of front connecting tabs 126*a*, 126*b* connecting the pair of extended sections 114*b*, 114*c* and 116*b*, 116*c* of the front and rear leg frame members 114, 116 with the pair of extended sections 112*b*, 112*c* of the arm frame member 112. In an embodiment, the pair of front connecting tabs 126*a*, 126*b* are flat tabs coupled to the arm frame member 112, the front leg frame member 114 and the rear leg frame member 116 for providing pivotal movement therebetween. For example, the pair of front connecting tabs 126*a*, 126*b* is welded to the pair of extended sections 112*b*, 112*c* of the arm frame member 112, and coupled to the pair of extended sections 114*b*, 114*c* and 116*b*, 116*c* of the front and rear leg frame members 114, 116 using fasteners, such as rivets, screws and the like. The pair of front connecting tabs 126*a*, 126*b* enables in pivotally connecting ends of the front and rear leg frame members 114, 116 to the arm frame member 112 and allow the rear leg frame member 116 to set immediately below and parallel to the arm frame member 112 when folded and the front leg frame member 114 to set immediately below and parallel to the rear leg frame member 116 when folded, as shown in FIG. 3.

Figure 5:
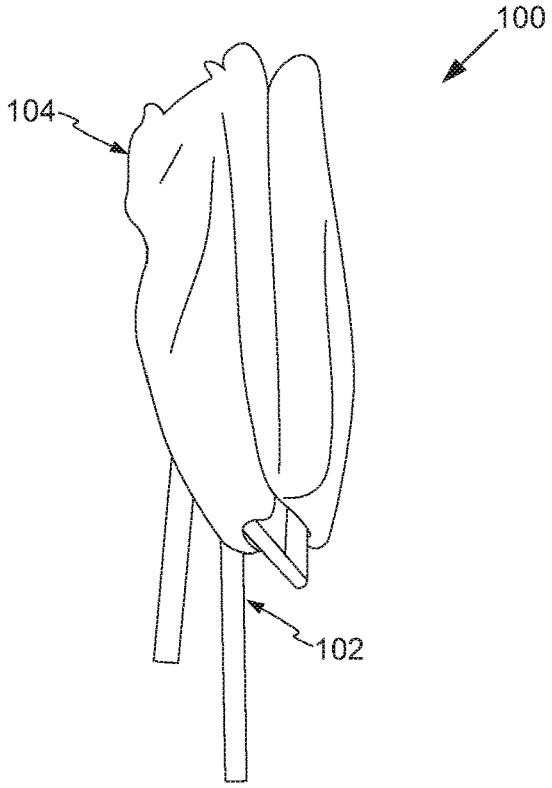

The plurality of connecting members also includes a pair of rear connecting tabs, such as connecting tab 128, connecting the pair of extended sections 110*b*, 110*c* of the back frame member 110 with the pair of extended sections 112*b*, 112*c* of the arm frame member 112. The pair of rear connecting tabs is welded to the pair of extended sections 112*b*, 112*c* of the arm frame member 112 and pivotally coupled to the pair of extended sections 110*b*, 110*c* of the back frame member 110 using the fasteners. The connection provided by the pair of rear connecting tabs enables the back frame member 110 to lie above the arm frame member 112 to provide a room for the cushion 106 between the cover member 104 the folded state of the folding chair 100, as shown in FIG. 5. According to an embodiment, the pair of extended sections 110*b*, 110*c* of the back frame member 110 may be directly coupled (for example, with the help of a fasteners) to the pair of extended sections 112*b*, 112*c* of the arm frame member 112 (without the help of pair of rear connecting tabs). The portions forward of the rear connecting tabs on the pair of extended sections 112*b*, 112*c* serves as an armrest of the chair 100 and also as the main support of the cover member 104 which is attached to and suspended from the arm frame member 112. The portions forward of the rear connecting tabs on the pair of extended sections 112*b*, 112*c* are also fixedly attached to the pair of armrest flanges 118*a*, 118*b* which serve to provide comfortable support for the user to rest his/her arms as well as stronger support for suspending the cover member 204 from the chair frame 102.

As shown in FIG. 2, the frame body 102 is in the upright position on the ground surface 120 in the unfolded state. In the unfolded state, the front and rear leg frame members 114, 116 are positioned inclined to each other with the pair of support extensions 114*d*, 114*e* and 116*d*, 116*e* thereof resting on the ground surface 120 and the intermediate sections 114*a*, 116*a* of the front and rear leg frame members 114, 116 are spaced apart. Specifically, the pair of support extensions 114*d*, 114*e* and 116*d*, 116*e* of the front and rear leg frame members 114, 116 are resting on the ground surface 120. Further, in the unfolded state of the frame body 102, the arm frame member 112 rests substantially parallel to the ground surface 120, on the pair of extended sections 114*b*, 114*c* and 116*b*, 116*c* of the front leg and rear leg frame members 114, 116. Also, in the unfolded state of the frame body 102, the back frame member 110 is positioned inclined to the arm frame member 112 and the rear leg frame member 116, and spaced apart substantially parallel to the front-leg frame member 114.

Figure 3:
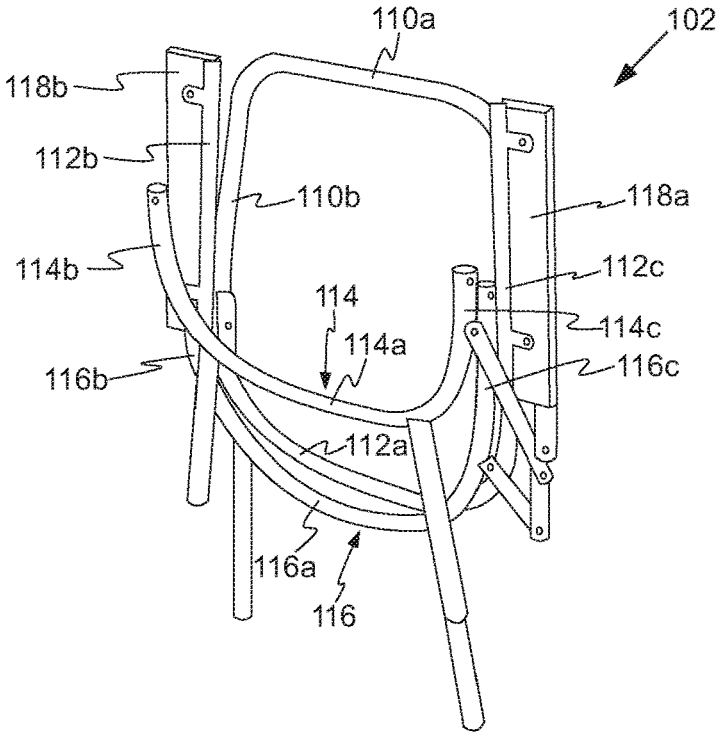

Referring now to FIG. 3, illustrated is perspective view of the frame body 102 of the folding chair 100 of FIG. 1 in folded state, in accordance with various embodiments of the present disclosure. It will be evident that the folded state of the frame body 102 would correspond to a folded state of the folding chair 100, when the frame body 102 is covered by the cover member 104 and the cushion 106 is arranged on the cover member 104, as shown in FIG. 5. Referring back to FIG. 3, in the folded state of the frame body 102, the pair of extended sections 116*b*, 116*c* of the rear leg frame member 116 rest on the pair of extended sections 114*b*, 114*c* of the front leg frame member 114 and the intermediate section 116*a* of the rear leg frame member 116 is spaced apart from the intermediate section 114*a* of the front leg frame member 114. Further, in the folded state of the frame body 102, the pair of extended sections 112*b*, 112*c* of the arm frame member 112 rest on the pair of extended sections 116*b*, 116*c* of the rear leg frame member 116. Also, in the folded state of the frame body 102, the pair of extended sections 110*b*, 110*c* of the back frame member 110 rest on the pair of extended sections 112*b*, 112*c* of the arm frame member 112 and the intermediate sections 110*a*, 112*a* of the back frame member 110 and the arm frame member 112 are positioned opposite to each other. This allows the frame body 102 (or the folding chair 100, as shown in FIG. 5) to attain the folded state with the compact configuration. Further, while folding the chair 100, the back frame member 110 is moved forward to rest parallel to the arm frame member 112, which mechanically pulls the front and rear leg frame members 114, 116 into a parallel compact configuration with the frame body 102 lying compactly together so that the chair 100 is efficient for shipping and storage. In simple words, while folding the chair 100, the back frame member 110 is pulled towards the arm frame member 112, and the front and rear leg frame members 114, 116 fold back as well.

Referring back to FIG. 1, the folding chair 100 is shown to include the cover member 104 and the cushion 106. The cover member 104 is configured to cover the frame body 102 and form at least a seat portion 130 and a backrest portion 132. Further, the seat portion 130 is supported by the arm frame member 112 and the backrest portion 132 is supported by the back frame member 110. According to an embodiment, the cover member 104 also includes a below seat panel 140 defining the front facing underside of the seat portion 130 which is integral to a seat top panel 131 defining (the top facing portion of) the seat portion 130. The cover member 104 also includes the backrest portion 132 which is integral to the rear edge of the seat portion 130 and specifically to the seat top panel 131. The cover member 104 includes a backrest panel 141, defining the backrest portion 132, which is integral to and joined along top and side edges to a back outside panel 142. The backrest panel 141 is integral with the seat top panel 131. The connection of the backrest panel 141 and the back outside panel 142 form a pouch configured to be mounted on and cover the back frame member 110. Therefore, the pouch (configured by the backrest panel 141 and the back outside panel 142) is configured to rest on the intermediate section 110*a* (shown in FIG. 2) and conform to the pair of extended sections 110*b*, 110*c* of the back frame member 110. The cover member 104 also includes a pair of side panels 145*a*, 145*b* integral with the seat top panel 131 and the backrest panel 141. The side panel 145*a* includes an inside side panel 144*c* which is integral to the seat top panel 131 and the backrest panel 141. The side panel 145*a* also includes an outside side panel 144*e* which is integral to the back outside panel 142 and the below seat panel 140 and the inside side panel 144*c*. The side panel 145*b* includes an inside side panel 144*d* which is integral to the seat top panel 131 and the backrest panel 141. The side panel 145*b* also includes an outside side panel 144*f* which is integral to the back outside panel 142 and the below seat panel 140 and the inside side panel 144*d*. The pair of side panels 145*a*, 145*b* are configured to be hollow pouches mounted on and cover the arm frame member 112. Also, the pair of side panels 145*a*, 145*b* are coupled to and supported by the pair of armrest flanges 118*a*, 118*b*.

Typically, a weight of a person sitting on the seat top panel 131 is supported on side edges of the below seat panel 140 by the pair of side panels 145*a*, 145*b* and on the back edge of the seat top panel 131 by the backrest portion 132. This allows the cover member 104 to fully support a the person sitting on the folding chair 100 while avoiding contact of the person with the frame body 102 resulting in a comfortable seating position.

In an embodiment, the cover member 104 is made of an upholstery fabric, such as a woven or unwoven fiber material. The cover member 104 completes the exterior look of the chair 100. The back outside panel 142 is supported at top of the back frame member 110, the pair of side panels 145*a*, 145*b* is supported at top to the arm frame member 112 (and stapled to the armrest flanges 118*a*, 118*b*), the below seat panel 140 and the back outside panel 142 are coupled to each other. These connection points allow the pair of side panels 145*a*, 145*b* to fold and unfold with the back outside panel 142 while also providing room for accommodating movements of the pair of front and rear links 122*a*, 122*b* and 124*a*, 124*b* within the pair of side panels 145*a*, 145*b*. Typically, the cover member 104 is configured to substantially hide unsightly folding mechanisms (formed by the plurality of connecting members, such as links and tabs), and provide an appealing upholstered look from every angle of viewing. Typically, the back outside panel 142 conceals the back frame member 110 and the outside side panels 144*e*, 144*f* conceals the arm frame member 112, the front and rear leg frame members 114, 116 (except the support extensions 114*d*, 114*e* and 116*d*, 116*e* thereof). The pair of inside side panels 144*c*, 144*d* produce a clean upholstered look from the inside view while hiding the folding mechanisms of chair 100.

In an embodiment, the cover member 104 further comprises a stiffening bar 150 (hidden and shown with dotted lines) arranged within the seat top panel 131 for providing stiffness to the seat top panel 131. Typically, the stiffener bar 150 is located along front edge of the seat top panel 131. In an example, the seat top panel 131 along the front edge includes a pocket configured to receive the stiffening bar 150. The stiffening bar 150 is flat rectangular structure, made of a suitable material which includes but not limited to metal, plastic, and wood. The stiffening bar 150 enables in avoiding contact or pinching of legs of the sitting person by supporting the lower thighs of the person. Further, the stiffening bar 150 allows in distributing the load from the legs of the sitting person across the entire seat top panel 131 and the cushion 106. Further, the stiffening bar 150 is not connected to any parts of the frame body 102 rather arranged inside the seat top panel 131 of the cover member 104. Typically, comfort is achieved by combining the flexibility of the cover member 104 in the center sides and back portions of the folding chair 100 with the rigidity of the stiffening bar 150 which provides firm wide support at the front of the folding chair 100.

The cover member 104 further comprises one or more elastic straps 152 for coupling the back outside panel 142 with the frame body 102. As shown, the elastic straps 152 are coupled to the back outside panel 142 of the backrest portion 132. The elastic straps 152 are explained further in greater in conjunction with FIG. 6.

The cushion 106 is operable to be arranged on the seat portion 130. In an embodiment, the cushion 106 is made of an upholstery fabric filled with a suitable material, which includes but not limited to foam, feather, or fiber and may include metallic springs. The cushion 106 is placed on top of the seat top panel 131 of the cover member 104 and the stiffening bar 150 to add padding above the cover member 104 and the stiffening bar 150. The cushion 106 also allows the seat top panel 131 and inside backrest panel 141 to conform to a predesigned shape when the chair 100 is not in use. Further, when the chair 100 is not in use the cushion 106 enables in retaining a shape of the cover member 104. Without the cushion 106, the cover member 104 would drape from the arm frame member 112 and the back frame member 110 with the pair of side panels 145*a*, 145*b*, the back outside panel 142 and the seat top panel 131 forming an undefined wrinkled curved shape. The weight and stiffness of the cushion 106 enables in holding the cover member 104 in the predesigned distinct planes.

Referring now to FIGS. 4 and 5, illustrated are perspective views of the folding chair 100 of FIG. 1 in assembled unfolded and folded states, respectively, in accordance with various embodiments of the present disclosure. As shown in FIG. 4, the folding chair 100 is in the upright and unfolded state that can be used of sitting. The cover member 104 substantially covers the frame body 102 and forms the seat portion 130 (shown in FIG. 1) and the backrest portion 132. As shown, the cover member 104 substantially covers the frame body 102 except for the pair of support extensions 114*d*, 114*e* and 116*d*, 116*e* of the front and rear leg frame members 114, 116 (shown in FIG. 2). Further, the cushion 106 is shown arranged on the seat portion 130 (shown in FIG. 1). In other words, the folding chair 100 of the present disclosure acts a sitting suspension system where the seat top panel 131 is supported on the arm frame member 112, the backrest portion 132 is held at the top by of the back frame member 110 and the suspended seat top panel 131 includes the stiffening bar 150 not attached to the frame body 102 to keep the front of the seat top panel 131 from pinching the legs of a person inwards when sitting on the chair 100.

Referring now to FIG. 5, the folding chair 100 is shown in the folded state, typically in which the frame body 102 attains the folded state, as shown in FIG. 3, with the cover member 104 arranged on the frame body 102. Further, the cushion 106 is sandwiched between the seat portion 130 and the backrest portion 132, allowing the folding chair 100 to attain folded state with the flat compact configuration. This allows convenient transportation of the folding chair 100.

Figure 6:
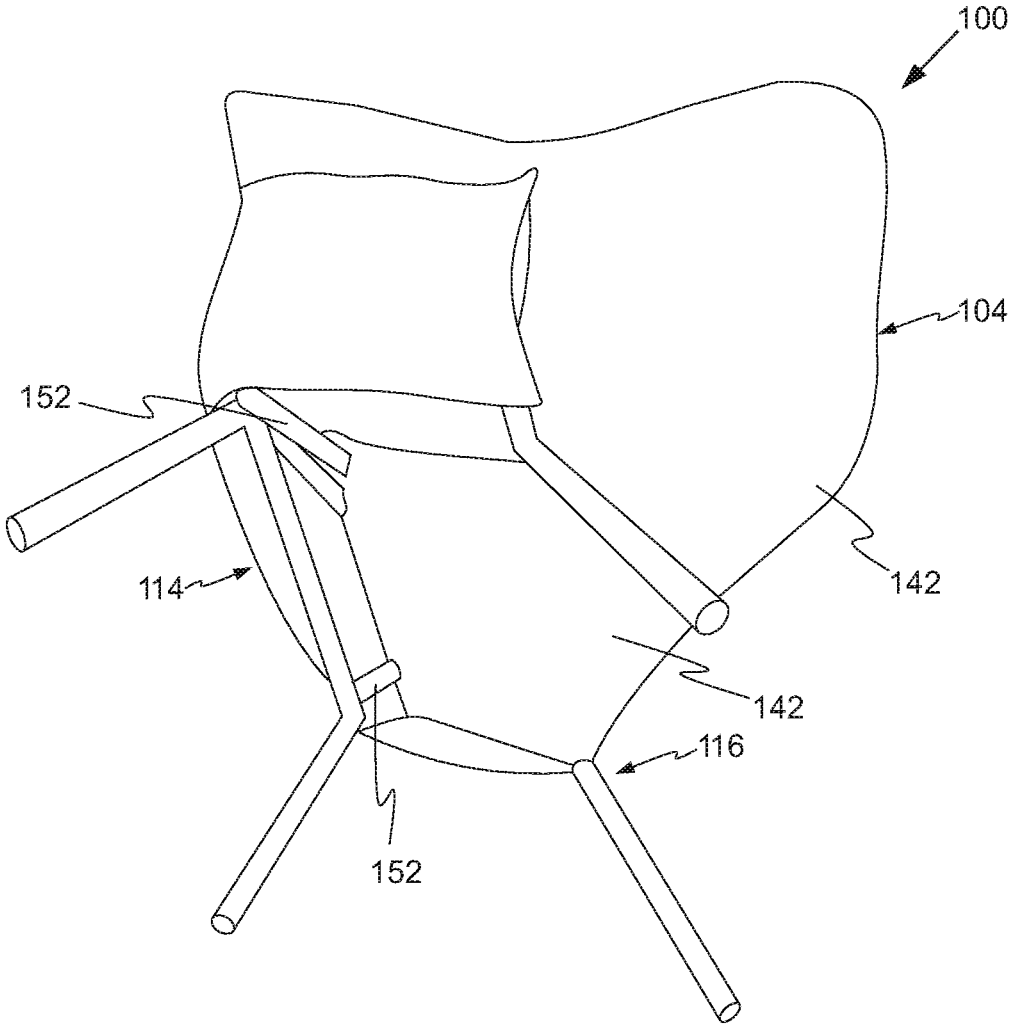
FIG. 6 is a bottom perspective view of the folding chair of FIG. 4, in accordance with an embodiment of the present disclosure.

Referring now to FIG. 6, illustrated is a bottom perspective view of the folding chair 100 of FIG. 4, in accordance with an embodiment of the present disclosure. As shown, the back outside panel 142 is connected under the chair 100 using the elastic straps 152 to the front leg frame member 114. The elastic straps 152 connect a bottom edge of the back outside panel 142 of the cover member 104 to the front leg frame member 114 so that the back outside panel 142 is tight and wrinkle free in the unfolded state of the chair 100, as shown in FIG. 4. In the unfolded state of the chair 100, the elastic straps 152 contracts so that the back outside panel 142 presents a smooth outward appearance. Further, in the folded state of the chair 100, the elastic straps 152 stretch to allow the back frame member 110 (shown in FIG. 2) to move away from the rear leg frame member 116. Also, the elastic straps 152 allows the back outside panel 142 to stay connected to the front leg frame member 114 during transition from the folded and unfolded states.

Figure 7:
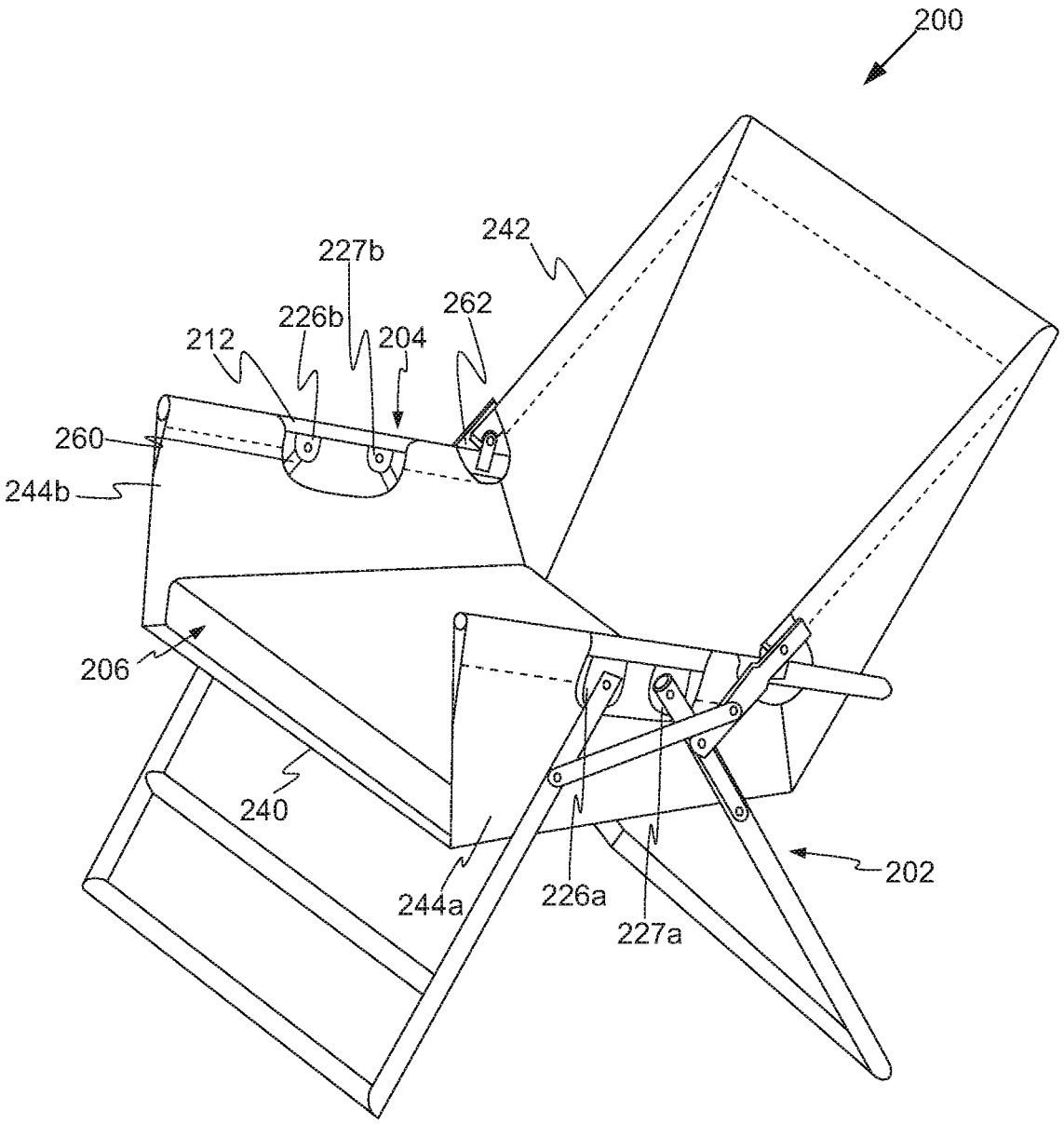
FIG. 7 is a perspective view of a folding chair in an assembled unfolded state, in accordance with another embodiment of the present disclosure.

FIG. 7 is a perspective view of a folding chair 200 in an assembled unfolded state, in accordance with another embodiment of the present disclosure. The folding chair 200 FIG. 2 is substantially similar to the folding chair 100 of FIG. 1. For example, the folding chair 200 of FIG. 2 also includes a frame body 202, a cover member 204 and a cushion 206. However, the folding chair 200 is also different from the folding chair 100 on certain aspects. For example, the configuration of the frame body 202 and the cover member 204 is slightly different from the configuration of the frame body 102 and the cover member 104 of FIG. 1, which will be explained in greater detail herein later. Otherwise, the folding chair 200 is structurally and functionally similar to the folding chair 100 of FIG. 1.

Figure 8:
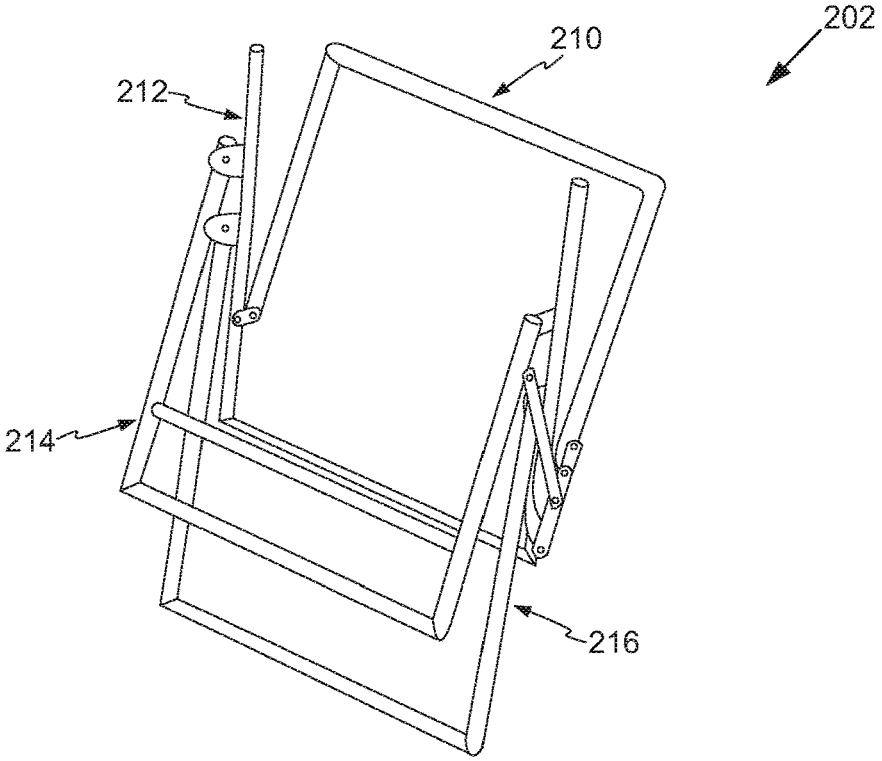
FIGS. 8 and 9 are perspective views of a frame body of the folding chair of FIG. 7 in folded and unfolded states, respectively, in accordance with various embodiments of the present disclosure.
Figure 9:
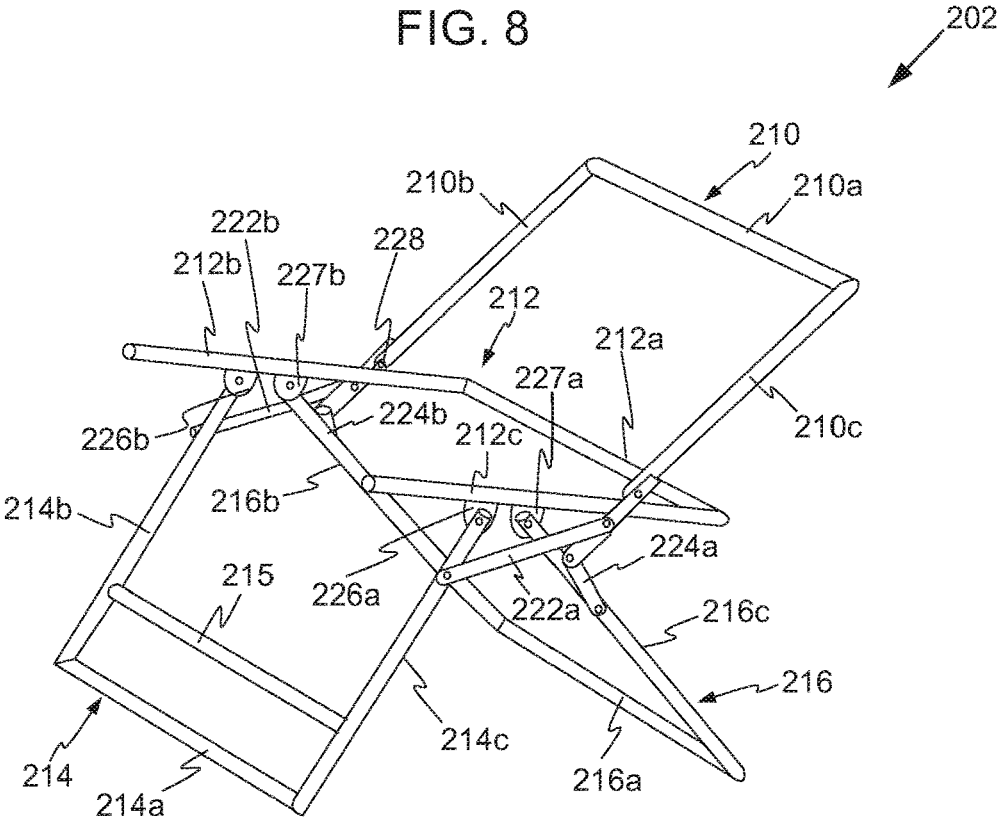

Referring now to FIGS. 8 and 9, illustrated are the perspective views of the frame body 202 of the folding chair 200 of FIG. 7 in folded and unfolded states, respectively, in accordance with various embodiments of the present disclosure. As shown in FIGS. 8 and 9, the frame body 202 includes a plurality of frame members, such as a back frame member 210, an arm frame member 212, a front leg frame member 214 and a rear leg frame member 216. The plurality of frame members, i.e. each of the back frame member 210, the arm frame member 212, the front leg frame member 214 and the rear leg frame member 216 is configured to have a U-shape, with sharp edges unlike curved edges of the plurality of frame members of the frame body 102. Also, the front and the rear leg frame members 214, 216 lacks pair of support extensions, such as the support extensions 114*d*, 114*e* and 116*d*, 116*e* (shown in FIG. 2) of the front and the rear leg frame members 114, 116 of the frame body 102. Therefore, the front and rear leg frame members 214, 216 are configured to support the frame body 202 in the upright position on the ground surface in the unfolded state, as shown in FIG. 9. Additionally, the front leg frame member 214 includes a cross-bar support member 215, which is missing from the front leg frame member 114 of the of the frame body 102, providing additional strength to the front leg frame member 114 for handing a weight of a person sitting on the chair 200. In an embodiment, the front leg frame member 214 may include more than one (such as two or three) cross-bar support members. Moreover, the arm frame member 212 lacks armrest flanges, such as the pair armrest flanges 118*a*, 118*b* (shown in FIG. 2) coupled to the pair of extended sections 112*b*, 112*c* of the arm frame member 112. Each of the back frame member 210, the arm frame member 212, the front leg frame member 214 and the rear leg frame member 216 includes an intermediate section, and a pair of extended sections extending from the intermediate section. As shown, the back frame member 210 includes an intermediate section 210*a* and the pair of extended sections 210*b*, 210*c*. Similarly, the arm frame member 212 includes an intermediate section 212*a* and the pair of extended sections 212*b*, 212*c*. Further, the front leg frame member 214 includes an intermediate section 214*a* and the pair of extended sections 214*b*, 214*c*. Moreover, the rear leg frame member 216 includes an intermediate section 216*a* and the pair of extended sections 216*b*, 216*c*.

The frame body 202 also includes a plurality of connecting members moveably coupling the plurality of frame members for allowing the frame body 202 to attain the folded state or the unfolded state. The plurality of connecting members includes a pair of front links 222*a*, 222*b* connecting the back frame member 210 with the front leg frame member 214 and a pair of rear links 224*a*, 224*b* connecting the back frame member 210 with the rear leg frame member 216. The plurality of connecting members also includes a pair of front connecting tabs 226*a*, 226*b* connecting the front leg frame member 214 with the arm frame member 212. The plurality of connecting members of the frame body 202, unlike frame body 102, includes a pair of intermediate connecting tabs 227*a*, 227*b* connecting the rear leg frame member 216 with the arm frame member 212. The plurality of connecting members also includes a pair of rear connecting tabs, such as a connecting tab 228, connecting the back frame member 210 with the arm frame member 212. In an embodiment, the back frame member 210 may be directly coupled to the arm frame member 212 with the help of fastener (without the help of connecting tab 228).

Referring back to FIG. 7, the cover member 204 comprises a seat panel 240. The cover member 204 also includes a back panel 242 defining a backrest portion, the back panel 242 is integral with the seat panel 240 and configured to be mounted on and cover the back frame member 210 (shown in FIG. 9). The cover member 204 further includes a pair of side panels 244*a*, 244*b* integral with the seat panel 240 and the back panel 242. The pair of side panels 244*a*, 244*b* are configured to be mounted on and cover the arm frame member 212. The cover member 204 may also include a stiffening bar (not shown, but similar to the stiffening bar 150 of FIG. 1) arranged within the seat panel 240 for providing stiffness to the seat panel 240. As shown, the cover member 204 (unlike the cover member 104 of FIG. 1) includes a plurality of cutouts, such as cutouts 260, 262, that allows the plurality of connecting members of the frame body 202 to be marginally visible therethrough. This allows the frame body 202 to attain the folded and the unfolded states without any possible interruptions from the cover member 204. Further, the cushion 206 is shown arranged on the seat panel 240 of the cover member 204.

Embodiments of the present disclosure substantially eliminate or at least partially address the aforementioned problems in the background and provide a folding chair. The folding chair of the present disclosure is configured or designed to hide a frame body of the chair, provide look and feel of a typical upholstered chair, and attain folded state with a flat compact configuration. The flat compact configuration in the folded state of the chair makes it efficient in terms of shipping and storage. Further, the frame body includes simple design that is easy to manufacture, using only four U-shaped frame members and few connecting members for moveably coupling them. The cover member substantially covers the frame body to provide a crisp tailored look of a fully upholstered chair. The stiffening bar of the cover member allows a person to sit in the chair without pinching the legs. Principally, the chair of the present disclosure is designed to have all the features of a conventional fully upholstered chair, which is not foldable in nature.

The embodiments illustrated and described herein as well as embodiments not specifically described herein but within the scope of the aspects of the invention constitute an exemplary folding chair.

The benefits and advantages described above may relate to one embodiment or may relate to several embodiments. The embodiments are not limited to those that solve any or all of the stated problems or those that have any or all of the stated benefits and advantages.

Aspects of any of the examples described above may be combined with aspects of any of the other examples described to form further examples without losing the effect sought.

The above description is given by way of example only and various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

What is claimed is:

1. A folding chair, comprising:

a frame body having:

a plurality of frame members comprising a back frame member, an arm frame member, a front leg frame member, and a rear leg frame member, and wherein the front and rear leg frame members are configured to support the frame body in an upright position on a ground surface in an unfolded state, each frame member having:

an intermediate section, and a pair of extended sections extending from the intermediate section forming a U-shaped frame member, and a plurality of connecting members moveably coupling the plurality of frame members for allowing the frame body to attain the unfolded state or a folded state with the plurality of frame members lying adjacent to one another in a compact configuration; and a cover member configured to cover the frame body to form at least a seat portion and a backrest portion, wherein the seat portion is supported by the arm frame member and the backrest portion is supported by the back frame member, wherein the cover member comprises a pair of side panels integral with a seat top panel and a backrest panel, the pair of side panels are configured to be mounted on and cover the arm frame member.

2. The folding chair as claimed in claim 1, wherein each of the front and rear leg frame members further comprises a pair of support extensions configured to support the frame body in the upright position on the ground surface in the unfolded state of the frame body.

3. The folding chair as claimed in claim 1, wherein the pair of extended sections of the front and rear leg frame members is pivotally coupled to the pair of extended sections of the arm frame member.

4. The folding chair as claimed in claim 1, wherein the pair of extended sections of the back frame member is pivotally coupled to the pair of extended sections of the arm frame member.

5. The folding chair as claimed in claim 1, wherein the plurality of connecting members comprises:

a pair of front links connecting the pair of extended sections of the back frame member to the pair of extended sections of the front leg frame member;

a pair of rear links connecting the pair of extended sections of the back frame member to the pair of extended sections of the rear leg frame member; and a pair of front connecting tabs connecting the pair of extended sections of the front leg frame member with the pair of extended sections of the arm frame member.

6. The folding chair as claimed in claim 5, wherein the plurality of connecting members further comprises a pair of rear connecting tabs connecting the pair of extended sections of the back frame member with the pair of extended sections of the arm frame member.

7. The folding chair as claimed in claim 5, wherein when the back frame member is pivoted forward towards the arm frame member during folding, the front leg frame member is pulled backwards by the pair of front links and the rear leg frame member is pulled backwards by the pair of rear links, allowing the arm frame member, the front leg frame member, the rear leg frame member, and the back frame member to lay adjacent to one another in the compact configuration.

8. The folding chair as claimed in claim 7, wherein in the folded state:

the pair of extended sections of the rear leg frame member rests on the pair of extended sections of the front leg frame member and the intermediate section of the rear leg frame member is spaced apart from the intermediate section of the front leg frame member;

the pair of extended sections of the arm frame member rests on the pair of extended sections of the rear leg frame member; and the pair of extended sections of the back frame member rests on the pair of extended sections of the arm frame member and the intermediate sections of the back frame member and the arm frame member are positioned opposite to each other.

9. The folding chair as claimed in claim 1, wherein in the unfolded state:

the front and rear leg frame members are positioned inclined to each other with the pair of support extensions thereof resting on the ground surface and the intermediate sections of the front and rear leg frame members are spaced apart;

the arm frame member rests substantially parallel to the ground surface, on the pair of extended sections of the front and rear leg frame members; and the back frame member is positioned inclined to the arm frame member and the rear leg frame member, and spaced apart substantially parallel to the front leg frame member.

10. The folding chair as claimed in claim 1, wherein each frame member comprises a single elongate member bent to form the U-shaped frame member having the intermediate section and the pair of extended sections extending from the intermediate section.

11. The folding chair as claimed in claim 1, wherein the cover member further comprises:

the seat top panel defining the seat portion; and the backrest panel defining the backrest portion, the backrest panel is integral with the seat top panel and configured to be mounted on and cover the back frame member;

wherein a weight of a person sitting on the seat top panel is supported on side edges of the seat top panel by the pair of side panels and on a back edge of the seat top panel by the backrest panel.

12. The folding chair as claimed in claim 11, wherein the cover member further comprises one or more elastic straps coupled to a back outside panel and operable to couple the back outside panel with the frame body.

13. The folding chair as claimed in claim 11, wherein the frame body further comprises a pair of armrest flanges coupled to the pair of extended sections of the arm frame member.

14. The folding chair as claimed in claim 13, wherein the pair of side panels is coupled to and supported by the pair of armrest flanges.

15. The folding chair claimed in claim 11, further comprising a cushion operable to be arranged on the seat portion of the cover member.

16. The folding chair as claimed in claim 11, further comprising a stiffener bar located along front edge of the seat panel.

* * * * *